United States Patent [19]

Conway

[11] 4,259,546

[45] Mar. 31, 1981

[54] ELECTRICAL FEEDTHROUGH SYSTEM FOR PRESSURIZED CONTAINERS

[75] Inventor: Harry E. Conway, Baltimore, Md.

[73] Assignee: The United States of America as represented by the Secretary of the Air Force, Washington, D.C.

[21] Appl. No.: 90,385

[22] Filed: Nov. 1, 1979

[51] Int. Cl.[3] ..... H01B 17/30

[52] U.S. Cl. ..... 174/153 R; 174/18

[58] Field of Search ..... 174/18, 52 S, 151, 152 R, 174/153 R; 339/94 A, 126 RS

[56] References Cited

FOREIGN PATENT DOCUMENTS

| | | | |
|---|---|---|---|
| 746296 | 3/1956 | United Kingdom | 174/151 |
| 879855 | 10/1961 | United Kingdom | 174/52 S |
| 1015677 | 1/1966 | United Kingdom | 174/153 R |

*Primary Examiner*—Laramie E. Askin

*Attorney, Agent, or Firm*—Donald J. Singer; Willard Matthews, Jr.

[57] ABSTRACT

An electrical feedthrough system for pressurized containers comprising a 'T' shaped flexible member adapted to pass through an opening in a container and an epoxy used as a secondary seal and support. A conductor passes through the 'T' shaped member which maintains a seal around the conductor. Electrical connections are made to terminals at either end of the conductor.

3 Claims, 2 Drawing Figures

ELECTRICAL FEEDTHROUGH SYSTEM FOR PRESSURIZED CONTAINERS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to electrical feedthrough systems and more particularly to such a system for pressurized containers.

In the electrical art it is frequently necessary to make electrical connections from the outside to the inside of containers which are either sealed, pressurized or liquid filled. Common practice, where moderate to high voltages are concerned, has been to utilize glass type headers.

A glass header consists of one or more metal conductors sealed in glass with ends extending from the glass for connection with circuit leads. The conductor material is required to have a coefficient of thermal expansion near that of the glass.

The glass in the header is bonded to a washer-like flange which is formed of a material having the proper thermal expansion coefficient but which also must be compatible for being affixed to the container by soldering, gluing or similar process.

Once in place, the glass header or feedthrough is rigid and subject to damage from handling or vibration and difficult to remove and replace. Additionally, it is not infrequent that the glass will break from high temperatures involved in the installation process.

Accordingly, occasions have arisen where the cost of headers, their repair and replacement, as well as time lost, is equal to or exceeds the cost of the entire system of which they are a part.

Therefore, to solve deficiencies found in the glass header used as a means of electrical feedthrough for containers, the following simplified system is presented.

SUMMARY OF THE INVENTION

The invention proposes a semiflexible electrical feedthrough utilizing a 'T' shaped member, having an electrical conductor passing therethrough, secured and sealed to the container. By forming an appropriately shaped aperture in the container the 'T' shaped member fits snugly in a recessed area with pressure in the vessel forcing the member into a sealing relationship with the container. By utilizing a flexible material such as Teflon for the 'T' shaped member, sealing qualities of the feedthrough are maintained while limited flexibility is added over other existing devices.

The invention is unaffected by thermal stresses during soldering or resoldering. Teflon material will withstand the moderate temperatures generated during soldering and the flexibility of the material will absorb any expansion of the conductor created by the heating.

It is, therefore, an object of the invention to provide a new and improved electrical feedthrough system for pressurized containers.

It is another object of the invention to provide a new and improved electrical feedthrough system that is simplified compared with known existing systems.

It is a further object of the invention to provide a new and improved electrical feedthrough system that resists breakage from handling.

It is still another object of the invention to provide a new and improved electrical feedthrough that is unaffected by heat.

It is still a further object of the invention to provide a new and improved electrical feedthrough that is easy to install and replace.

It is another object of the invention to provide a new and improved electrical feedthrough for pressurized containers that is readily sealed, independent of container material.

It is another object of the invention to provide a new and improved method for installing electrical feedthrough in pressurized containers.

These and other advantages, features and objects of the invention will become more apparent from the following description taken in connection with the illustrative embodiment in the accompanying drawings.

DESCRIPTION OF THE PREFERRED EMBODIMENT

Figure 1:
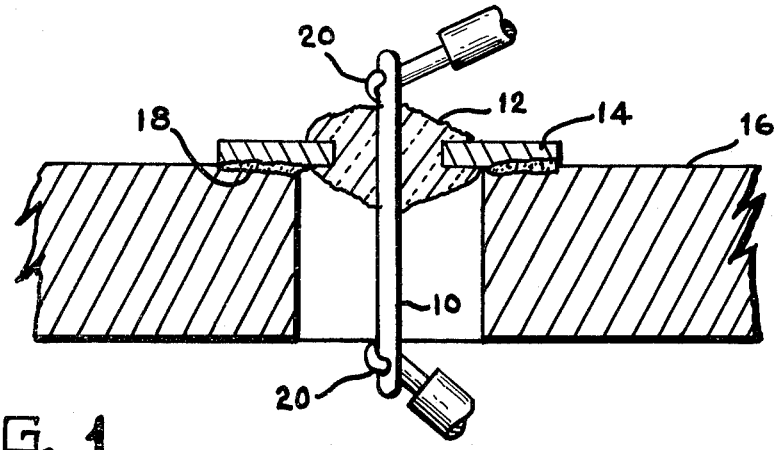
FIG. 1 PRIOR ART
FIG. 1 is a side elevation view partly in section of a prior art device.

FIG. 1 shows an electrial feedthrough system currently utilized for pressurized containers. A metal conductor 10 having a coefficient of thermal expansion near that of glass is secured in glass bead 12. A metal washer 14 holds the glass bead and is secured to a metal chassis or container 16. The most common means for securing the header is brazing or soldering (18). Leads 20 are soldered to conductor 10 to form an electrical circuit.

Figure 2:
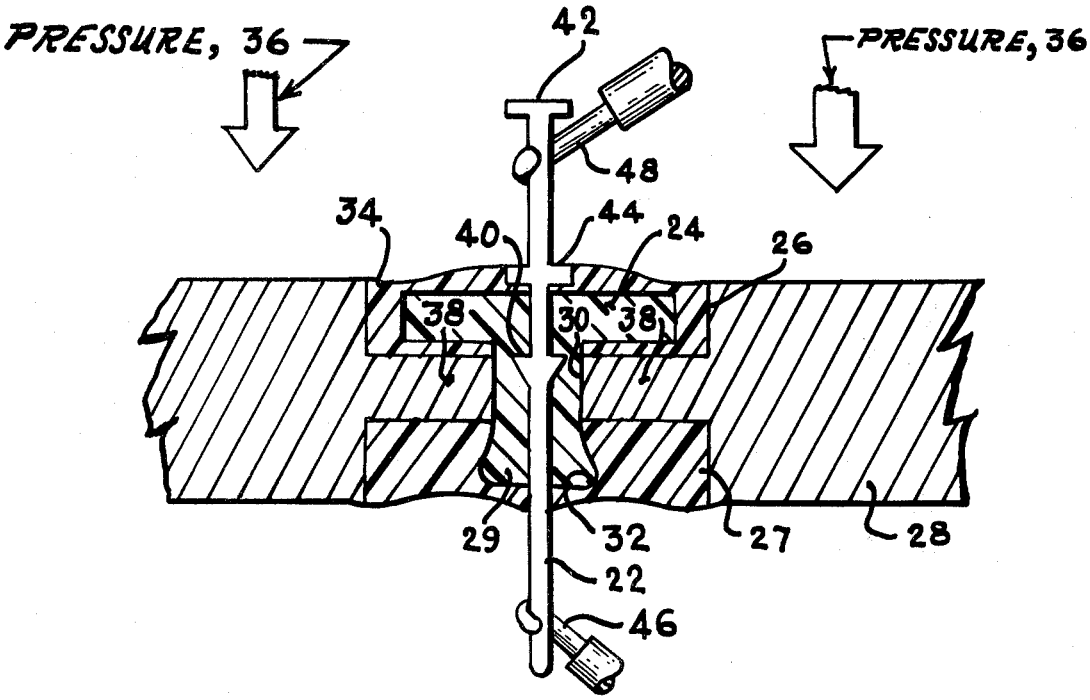
FIG. 2 is a side elevation view partly in section of the invention.

The improvement over the prior art is shown in FIG. 2. A metal conductor 22 passes through a semiflexible insulative material 24. The material may be Teflon or other suitable substance. Insulator 24 is generally 'T' shaped and fits into the recessed area 26 of the container 28. End 29 passes through restricted area 30 of container 28. In order to facilitate installation, end 28 is chamfered at 32. Although restricted aperture 30 shows substantial clearance, insulator 24 is pressed through the aperture and fits in a tight seal relationship with the sides of the aperture.

The insulator material extending beyond the aperture expands to its normal size 29 and holds the insulator in place. Epoxy mixture 34 flows into recesses 26 and 27 providing additional mechanical support and sealing. Pressure 36 inside the container forces the broad face of insulator 24 against shelf-like member 38 resulting from the reduced aperture size and aids in the elimination of leakage around the insulator.

Conductor 22 is provided with a pair of projections 40 which facilitate the placement of the conductor into the insulator and because of their tapered design inhibit removal from the insulator. A pair of flanges 42, 44 provide a flat surface to aid in inserting the conductor and also limit the movement of the conductor. Wires 46, 48 are soldered to the conductor in a manner similar to the prior art.

The conductor of the invention will have limited movement and resist breakage from handling and mild abuse. Heating of the conductor for soldering will cause Teflon or the selected insulative material to flow around the conductor and maintain the seal.

In order to remove the feedthrough system, once the leads have been disconnected, the conductor 22 is removed from the insulator 24 and the insulator and epoxy removed with a drill bit or reamer. Once restricted aperture 30 and counterbored areas 26, 27 are restored, another feedthrough system may be installed.

Although the invention has been described with reference to a particular embodiment, it will be understood to those skilled in the art that the invention is capable of a variety of alternative embodiments within the spirit and scope of the appended claims.

I claim:

1. A pressurized containment device with electrical feedthrough means comprising A pressurized containment vessel having an aperture through a wall thereof, an enlarged recessed region surrounding the aperture on the outer surface of said wall and a matching enlarged recessed region surrounding the aperture on the interior surface of said wall, a plug of insulative material having a flange on one end thereof, said plug having resilience and being slightly larger than said aperture, said plug being forced through said aperture whereby the flanged end thereof is substantially in register with the inner wall surface recessed region and the distal end thereof is extended through said aperture and expanded to its normal size, a metal conductor rod through said plug extending into the interior and beyond the outer surface of said containment vessel, said rod having a first flange on its interior end, a second flange adjacent the inner surface of the plug flange, and a tapered projection at a point within the length of said plug, said second flange and said tapered projection cooperating to inhibit insertion and extraction of said rod, and epoxy filling said enlarged recessed regions.

2. A pressurized containment device as defined in claim 1 wherein said plug is made of polytetrafluoroethylene.

3. A pressurized containment device as defined in claim 2 wherein the distal end of said plug is chamfered.

* * * * *